United States Patent [19]

Boggs

[11] Patent Number: 4,490,878

[45] Date of Patent: Jan. 1, 1985

[54] SHOE SCRAPER

[76] Inventor: Eulema G. Boggs, 403 Mariposa, Carlsbad, N. Mex. 88220

[21] Appl. No.: 501,842

[22] Filed: Jun. 7, 1983

[51] Int. Cl.[3] ..... A47L 23/22

[52] U.S. Cl. ..... 15/237; D32/47

[58] Field of Search ..... 15/237-241; D32/47

[56] References Cited

U.S. PATENT DOCUMENTS 3,028,617 4/1962 Racina ..... 15/237 X 3,751,753 8/1973 Drewitz ..... 15/237

FOREIGN PATENT DOCUMENTS 15439 of 1887 United Kingdom ..... 15/238

23622 of 1907 United Kingdom ..... 15/237

*Primary Examiner*—Edward L. Roberts

[57] ABSTRACT

A versatile flat mount shoe scraper comprising a framed grate, an arch standard extending downwardly with a scraper bar secured to the terminated ends of the standard, which is then secured to the framed grate, thereby providing a base one would stand upright on and a grab bar one would grip for balance while removing debris from ones shoes on the grate and scraper bar by placing ones shoes on same, applying light pressure and pulling backwards to ones self. Decorative swirls on the framed grate are for stability and decor. An upper brace bar on the arch standard accommodates the following attachments: address plate and flower pot holders.

1 Claim, 4 Drawing Figures

SHOE SCRAPER

SUMMARY OF THE INVENTION

This invention relates to a versatile, flat mount, free standing shoe scraper with various attachments for multiple uses.

Most if not all shoe scrapers to date, clean debris from ones shoes and that is their only function. Most are unsightly left in the front viewing area of ones dwelling, yet all perform the one task of removing debris from ones shoes by placing ones shoe over the scraper bar, applying a light pressure and pulling back toward ones self.

It is an object of this invention to provide a low cost, versatile, flat mount, free standing, shoe scraper which is easily manufactured.

It is another object of this invention to provide an ornate, decorative shoe scraper that will enhance the decor of ones dwelling.

It is a further object of this invention to provide attachments to make this shoe scraper a yard ornament that will display potted plants and flowers, an address plate.

It is still yet another object of this invention to provide a grab bar at the top of this shoe scraper to serve as a grip for balance with a flat mount grate base with extended curved swirls for stability to stand on for removing smaller particles of debris from ones shoe soles and a scraper bar to the front of the grate for removing mud and heavy debris from ones shoes.

These and other objects and advantages of this invention will become apparent when viewed in light of the accompanying drawings and detailed description.

BRIEF DESCRIPTION OF THE DRAWINGS

FIG. 2 is a vertical arch standard with an upper brace bar, a lower scraper bar and an address plate.

FIG. 3 is an attachment of a determined length of metal bar with cylindrical ring shaped portions at each end.

DETAILED DESCRIPTION

Figure 1:
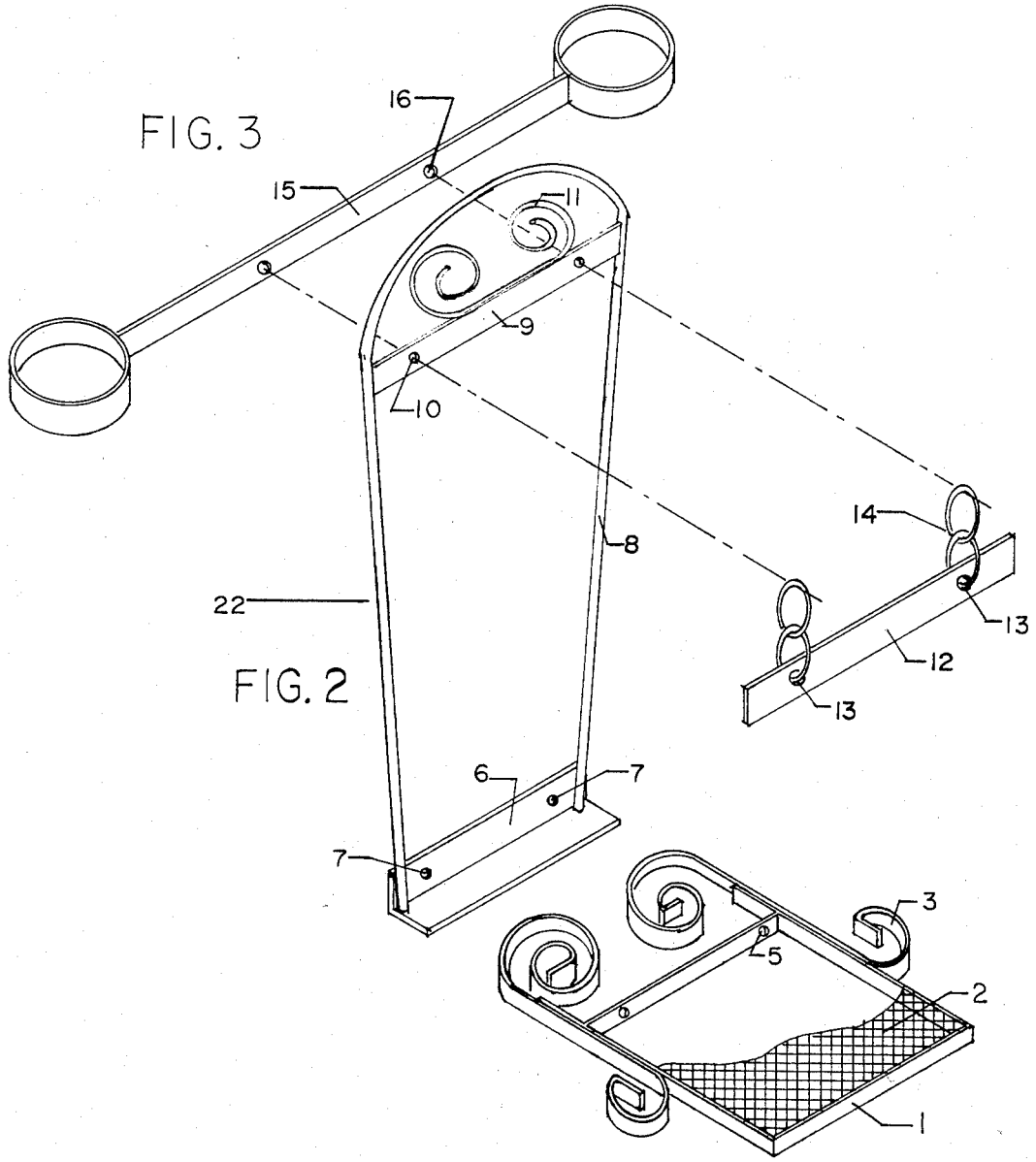
FIG. 1 is a framed grate base with curved swirls for stability.
Figure 4:
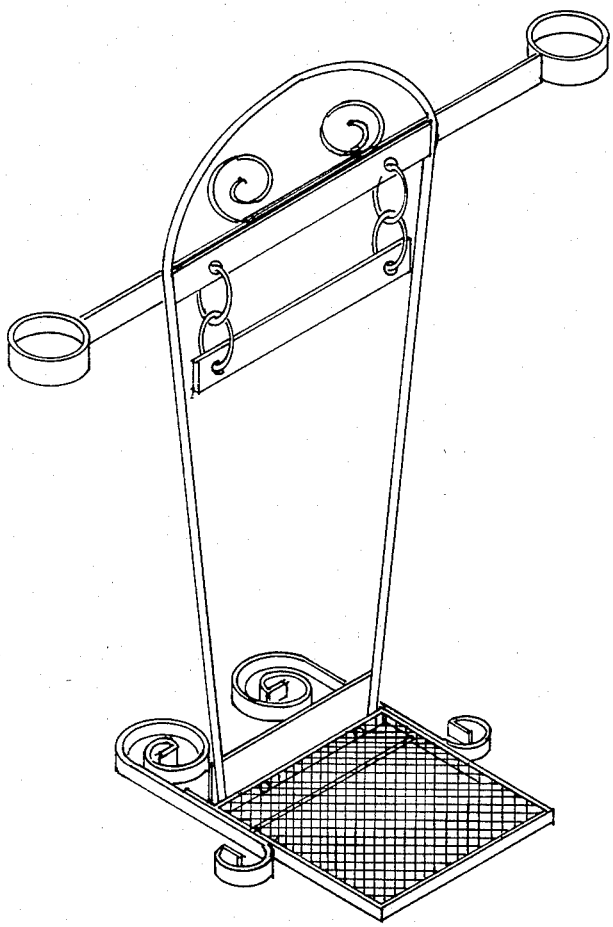
FIG. 4 a view of the versatile shoe scraper assembled.

Referring to the drawings where like reference numerals designate like parts, the versatile shoe scraper is designated generally as 22. The shoe scraper 22 comprises, FIG. 1 is a metal bar frame 1 having two holes 5 a respective distance apart, in the frontward section of frame 1. Grate 2 is secured within the dimensions of frame 1. Curved swirls 3, of metal bar are secured on two parallel sides of frame 1 and extending beyond and frontward of same for stability.

FIG. 2 shows a vertical standard 8 of metal rod in a arch downwardly inverted U terminating with standard rods 8 parallel, one to the other, tapering closer together at the lower ends and of equal lengths. An extended length of angle iron, or suitable material, constitutes the scraper bar 6 having two holes 7 a respective distance apart, secured horizontally to terminated ends of vertical standard rods 8. Holes 7 in scraper bar 6 are attached to holes 5 in frame 1 with bolts and nuts. Thereby forming a base one would stand upright on and an arch grab bar one would grasp for balance while cleaning ones shoes by moving same over grate 2 and scraper bar 6. Now there is a curved swirl 11 of wrought iron, secured atop the upper brace bar 9 which is of metal bar and has two holes 10 a respective distance apart, secured just below the arch and between the standard rods 8. An address plate 12 of metal bar or suitable material and of a determined length, with two holes 13 a respective distance apart, through which hooks or chains 14 are attached.

In FIG. 3 cylindrical ring shaped portions 15 are at each end of a determined length of metal bar, having two holes 16 a respective distance apart, are attached simultaneously with loose ends of hooks or chains 14 to holes 10 in upper brace bar 9 using bolts and nuts.

Having described the invention in detail, it should be obvious to one of ordinary skill in the art that slight modifications, substitutions and varations may be made without departing from the scope and spirit of the invention.

I claim:

1. A shoe scraper comprising:

a base consisting of a horizontal grate defining a scraping surface and having a frame extending around said grate;

an upright arched standard defined by spaced apart vertical leg portions connected at the upper ends thereof by an arched portion of sufficient height to be gripped by a person standing on said grate;

a scraper bar secured between the leg portions adjacent the lower ends thereof and providing a horizontal scraping edge; means for attaching said scraper bar to said grate frame such that said scraper edge extends above said grate frame;

an upper horizontal brace bar extending between said leg portions at the upper ends thereof adjacent said arched portion; and a horizontal bar means attached to said brace bar and extending beyond the ends thereof, each end of said bar means terminating in a cylindrical, ring shaped portion.

* * * * *